US009114512B2

(12) United States Patent
Beer et al.

(10) Patent No.: US 9,114,512 B2
(45) Date of Patent: Aug. 25, 2015

(54) PROCESS AND APPARATUS FOR LOCATING LIGHT EMITTING DIODE IN A HAND TOOL HEAD ASSEMBLY

(71) Applicant: Snap-on Incorporated, Kenosha, WI (US)

(72) Inventors: Joshua M Beer, Racine, WI (US); Kenneth C Happ, Burlington, WI (US)

(73) Assignee: Snap-on Incorporated, Kenosha, WI (US)

( * ) Notice: Subject to any disclaimer, the term of this patent is extended or adjusted under 35 U.S.C. 154(b) by 290 days.

(21) Appl. No.: 13/894,820

(22) Filed: May 15, 2013

(65) Prior Publication Data

US 2014/0338504 A1 Nov. 20, 2014

(51) Int. Cl.

| | |
|---|---|
| ***B25B 23/18*** | (2006.01) |
| ***B25B 23/00*** | (2006.01) |
| ***B25B 21/00*** | (2006.01) |
| ***B25F 5/02*** | (2006.01) |

(52) U.S. Cl.

CPC ..... *B25B 23/00* (2013.01); *B25B 21/004* (2013.01); *B25B 23/18* (2013.01); *B25F 5/02* (2013.01); *Y10T 29/49002* (2015.01)

(58) Field of Classification Search

CPC ..... B25B 23/18; B25B 27/0014; B25F 5/02
USPC ..... 362/119, 120; 81/57.39; 173/46
See application file for complete search history.

(56) References Cited

U.S. PATENT DOCUMENTS

| | | | | |
|---|---|---|---|---|
| 5,353,474 | A * | 10/1994 | Good et al. | 16/421 |
| 5,670,745 | A * | 9/1997 | Yajima et al. | 174/50.5 |
| 7,188,966 | B1 * | 3/2007 | Lin | 362/119 |
| 8,104,913 | B2 * | 1/2012 | Wright | 362/119 |
| 2006/0262519 | A1 * | 11/2006 | Hirschburger et al. | 362/119 |
| 2008/0068827 | A1 * | 3/2008 | Chang | 362/119 |
| 2010/0258329 | A1 * | 10/2010 | Engelbach et al. | 174/50 |
| 2010/0299857 | A1 * | 12/2010 | Stief et al. | 15/106 |
| 2011/0058356 | A1 * | 3/2011 | Friedman et al. | 362/119 |
| 2013/0271043 | A1 * | 10/2013 | Sergyeyenko et al. | 315/312 |

FOREIGN PATENT DOCUMENTS

| | | |
|---|---|---|
| JP | 2013071188 | 4/2013 |
| WO | WO 2011/111850 A1 | 9/2011 |
| WO | WO 2013/065222 A1 | 5/2013 |

OTHER PUBLICATIONS

Great Britain Combined Search and Examination Report for GB1407818.2 dated Sep. 19, 2014.

* cited by examiner

*Primary Examiner* — Ali Alavi
(74) *Attorney, Agent, or Firm* — Seyfarth Shaw LLP

(57) ABSTRACT

A motorized hand tool, such as a cordless ratchet wrench, is configured for reducing part count and reducing assembly processes. The motorized hand tool includes an overmolded window for a light emitting diode (LED) in a clamshell housing. An LED is secured within the clamshell housing by conductors extending from the LED that are encapsulated in rigid sleeves. The rigid sleeves provide a friction fit in a channel between fingers molded in the clamshell housing. A switch assembly of the motorized hand tool is mounted in the clamshell housing and covers channel to contains the conductors and sleeves. By containment of the rigid sleeves and conductors, the LED is located securely in the overmolded window.

14 Claims, 7 Drawing Sheets

PROCESS AND APPARATUS FOR LOCATING LIGHT EMITTING DIODE IN A HAND TOOL HEAD ASSEMBLY

TECHNICAL FIELD OF THE INVENTION

The present invention relates to a motorized hand tool for applying torque to a work piece. More particularly, the present invention relates to a clamshell housing geometry for securing an LED in a motorized hand tool.

BACKGROUND OF THE INVENTION

Power hand tools, such as motorized ratchet wrenches and drivers, are commonly used in automotive, industrial and household applications to install and remove threaded fasteners and to apply a torque and/or angular displacement to a work piece such as a threaded fastener, for example. Motorized hand tools, such as cordless power ratchets and drivers, generally include an electric motor contained in a clamshell housing along with other components such as switches, light emitting diodes (LEDs), and batteries, for example. The clamshell housing generally includes two or more housing portions fastened together by fasteners such as screws or rivets. Windows in the clamshell housings may be provided for mounting the LEDs. The windows may be overmolded with a transparent or semitransparent material such as rubber or plastic to allow passage of light from the LEDs while protecting the internal components from water, dust and other foreign material.

Securely locating an LED in the clamshell housing has previously been accomplished by mounting the LED to a separate component such as a snap fit plastic insert or printed circuit board (PCB) before installing the LED and the separate component in the housing. These techniques have increased manufacturing costs by increasing the assembly steps and number of parts used to manufacture the motorized hand tool.

SUMMARY OF THE INVENTION

According to aspects of the present invention, the cost of a motorized hand tool, such as a cordless ratchet wrench, may be reduced through reduction of parts count and by eliminating the manufacturing steps involved with installing a light emitting diode (LED) in the clamshell housing. According to an embodiment of the present invention, geometry inside a plastic overmolded clamshell housing portion is configured to engage an LED and its conductors to protect the LED and securely locate the LED in the clamshell housing.

According to embodiments of the present invention, a motorized hand tool includes fingers molded in a clamshell housing to locate an LED by defining channels configured for receiving conductors extending from the LED. The conductors may be overmolded or enclosed in a shrink wrap material to provide a rigid sleeve around the each of conductors. Each conductor is mounted in a channel defined by fingers extending into the clamshell housing by friction fit between the rigid sleeve and the fingers. The LED is securely located in a window extending through the clamshell housing by trapping the encapsulated conductors between the fingers.

According to aspects of the present invention, an internal component such as a switch assembly is mounted in the clamshell housing over the fingers. The internal component covers the channels to contain the conductors of the LED in the channels. This avoids the use of snap fit components, additional fasteners or adhesives, which add cost to the manufacturing process.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1A:
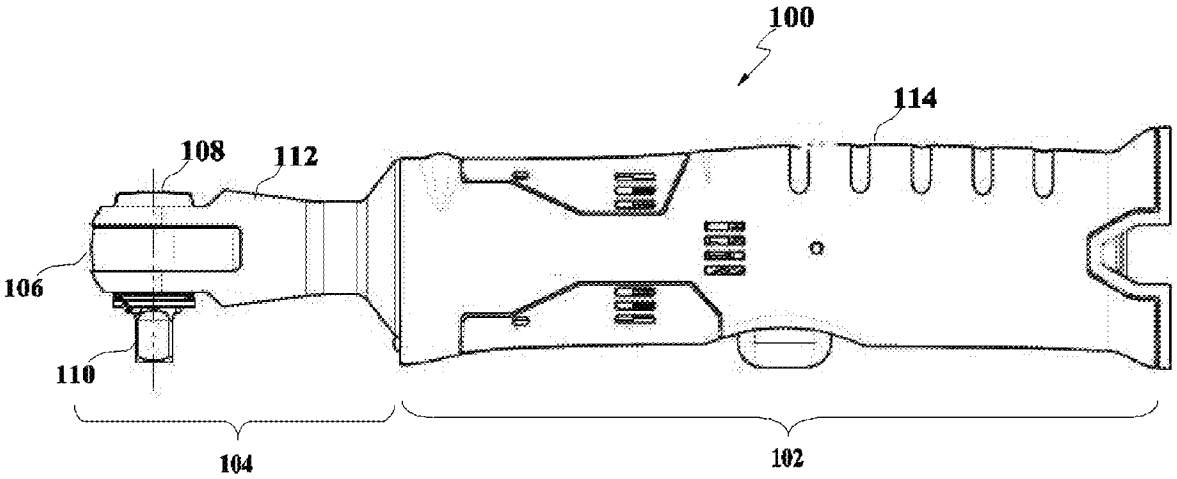
FIG. 1A is a side view drawing illustrating an exemplar tool, such as cordless ratchet tool including a ratchet head assembly coupled to a motor assembly, in accordance with an embodiment of the present invention.

It should be understood that the comments included in the notes as well as the materials, dimensions and tolerances discussed therein are simply proposals such that one skilled in the art would be able to modify the proposals within the scope of the present invention.

DETAILED DESCRIPTION OF THE EMBODIMENTS

While this invention is susceptible of embodiments in many different forms, there is shown in the drawings, and will herein be described in detail, a preferred embodiment of the invention with the understanding that the present invention is to be considered as an exemplification of the principles of the invention and is not intended to limit the broad aspect of the invention to embodiments illustrated.

Figure 1B:
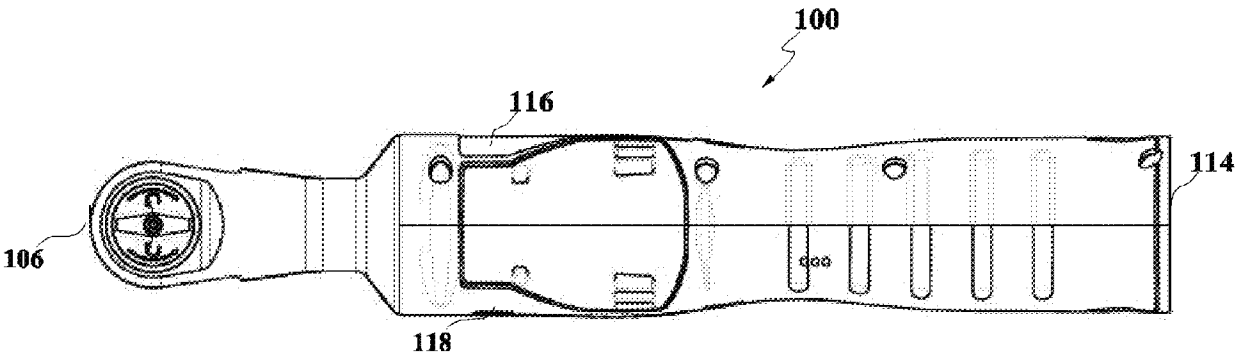
FIG. 1B is a top view drawing illustrating an exemplar tool, such as a cordless ratchet tool including a ratchet head assembly coupled to a motor assembly, in accordance with an embodiment of the present invention.

Embodiments of the present invention may be implemented in a motorized hand tool, such as, for example, the cordless ratchet tool shown in FIG. 1A. The cordless ratchet tool 100 includes a handle portion 102 coupled to a driver portion 104 The driver portion 104 may include a ratchet head assembly 106 including a ratchet housing 112, ratchet head 110, and selector knob 108, for example. The handle portion 102 may include a main housing 114 enclosing an electric motor, a switch assembly and one or more status indicators, such as light emitting diodes (LED), for example. FIG. 1B shows a top view of the cordless ratchet tool 100. Referring to FIG. 1B, the main housing 114 may be assembled from two or more clamshell housing portions 116, 118 fastened together and securely attached to the ratchet head assembly 106.

Figure 2:
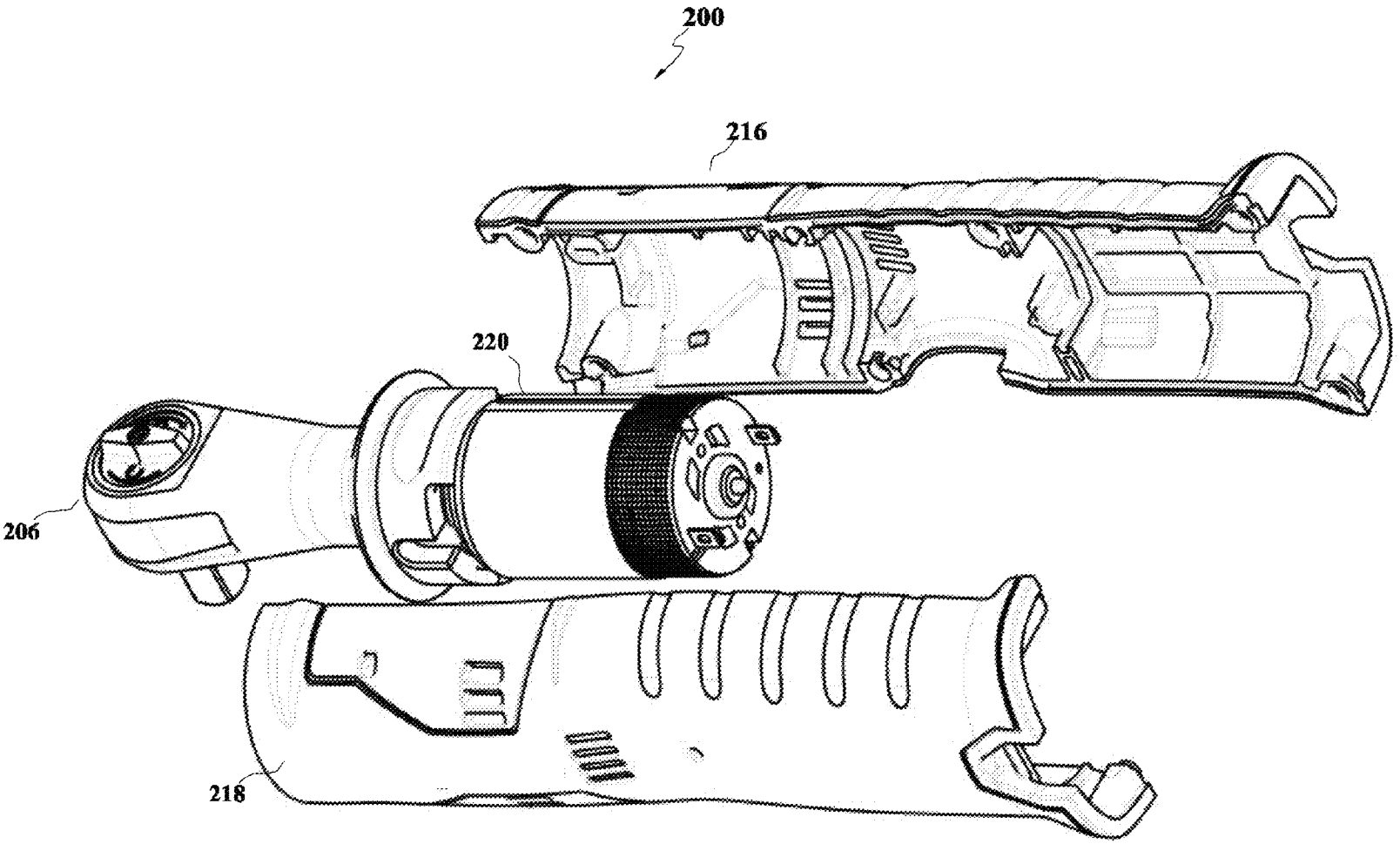
FIG. 2 is an exploded perspective view drawing of an exemplar tool having a ratchet head, motor and clamshell housing assembly of a cordless ratchet tool in accordance with an embodiment of the present invention.

FIG. 2 shows a ratchet head assembly 206 of a cordless ratchet tool assembly 200 coupled to a motor assembly 220 according to an aspect of the present invention. A first clamshell housing portion 216 and second clamshell housing portion 218 of the cordless ratchet tool assembly 200 are configured for assembly around the motor assembly 220.

Figure 3A:
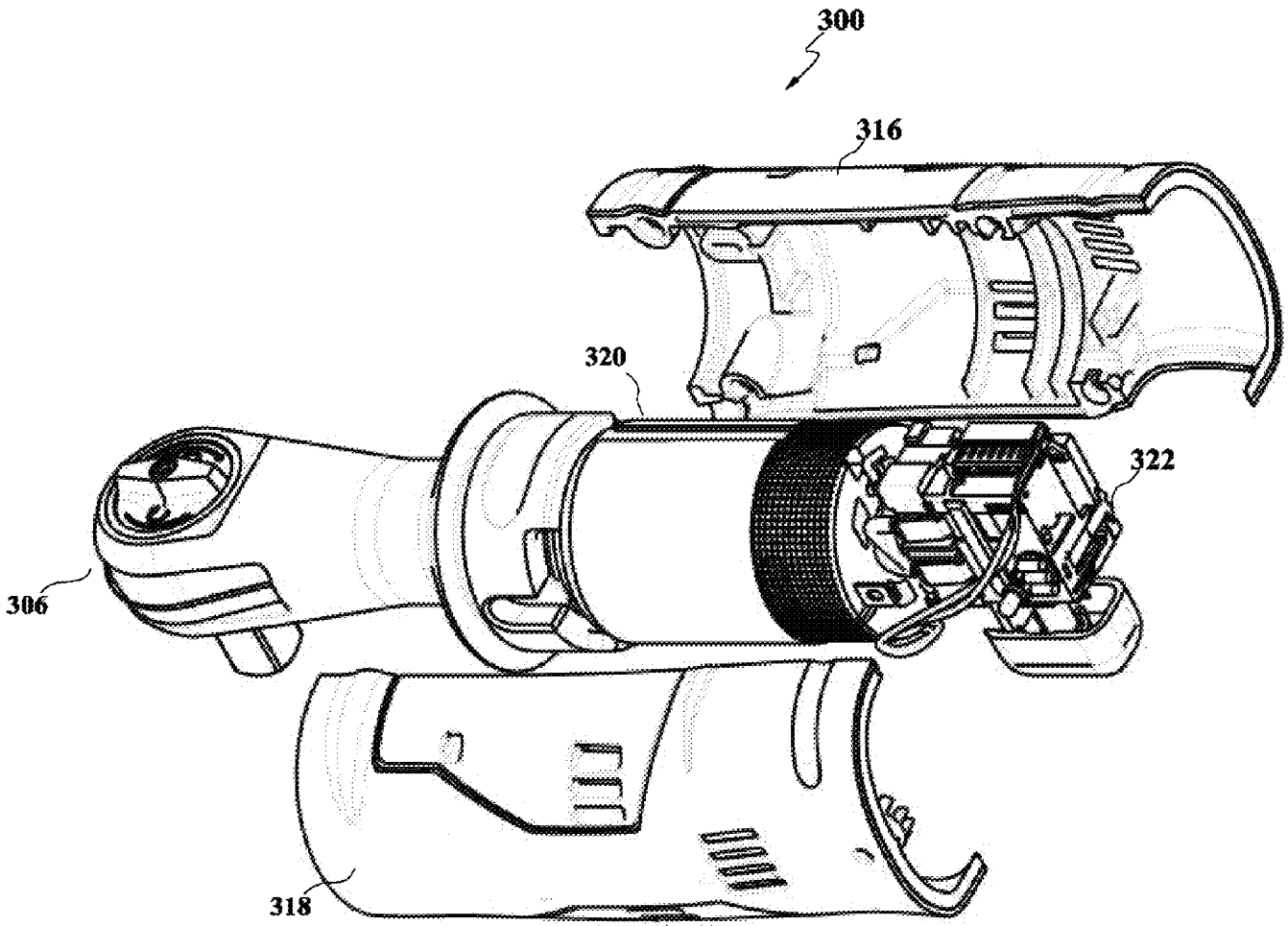
FIGS. 3A and 3B are exploded perspective view drawings of an exemplar tool having a ratchet head, motor, switch and clamshell housing assembly of a cordless ratchet tool in accordance with an embodiment of the present invention.
Figure 3B:
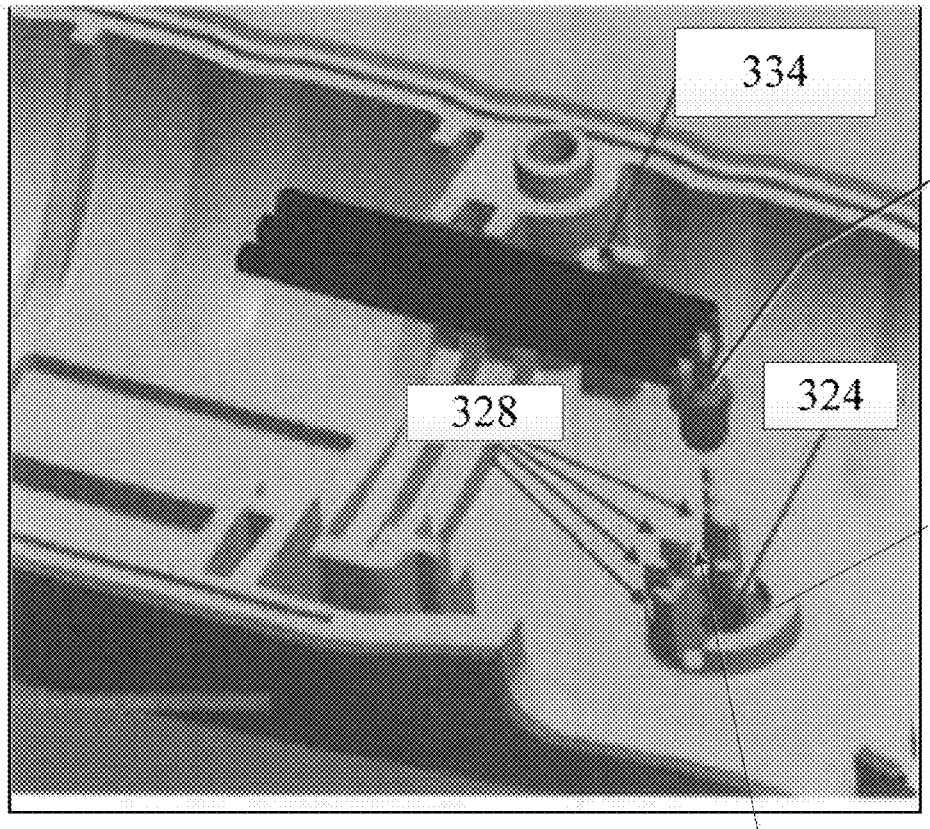

FIGS. 3A and 3B show a ratchet head assembly 306 of a cordless ratchet tool assembly 300 coupled to a motor assembly 320 and a switch assembly 322 according to another aspect of the present invention. A first clamshell housing portion 316 and second clamshell housing portion 318 of the cordless ratchet tool assembly 300 are configured for assembly around the motor assembly 320.

The switch assembly 322 may be coupled to the motor assembly 320 and/or to a source of power such as one or more batteries (not shown). One or more LEDs 332 may be coupled to the power source via circuitry configured for controlling functions of the tool, for example. The one or more LEDs 332 are configured for viewing through the first clamshell housing portion 316 and/or the second clamshell housing portion 318. Portions of the circuitry coupled to the LEDs 332 may be included in the switch assembly 322 or may be located separately within the clamshell housing portions 316, 318, for example.

The clamshell housing includes one or more windows 324 arranged for locating a corresponding LED 322 to allow a user to view light emitted by the LED. According to an embodiment of the present invention, a window 324 in the second clamshell housing portion 318 is overmolded with a transparent or semitransparent material such as a semitransparent rubber or plastic, for example. Alternatively a separate window covering element may be installed over the window 324 by snap fit, glue or other fastening means. The window 324 is at least partially bounded by a window boss 326 extending inward from the second clamshell housing portion 318.

The clamshell housing portion 318 includes a set of fingers 328 and a set of channels 330 defined by spaces between the fingers 328. According to an aspect of the present invention, conductors extending from the LED 332 are each enclosed in a rigid sleeve 334. In one embodiment of the present invention, the rigid sleeve may be formed by overmolding the conductors extending from an LED before installing the overmolded conductors in the clamshell housing. In another embodiment, the rigid sleeve may be formed by shrink wrapping the conductors with a plastic heat shrink tubing, for example. The conductors and rigid sleeves 334 are installed in the set of channels 330 and retained by a friction fit between the fingers 328 and each of the rigid sleeves 334.

The LED 332 is inserted into a friction fit hole in the rubber overmolded portion of the window 324 which helps keep the LED 332 in place and cushions the LED 332 to protect it from drop or impact damage.

According to another aspect of the present invention, the switch subassembly 322 is installed over the channels 330 and captures each of the LED conductors and rigid sleeves 334 in their respective channel 330. Although embodiments of the present invention are described which include the use of a switch assembly 322 to capture each LED conductors and rigid sleeves 334 in their respective channel 330, it should be understood that alternative embodiments of the present invention may include the use of one or more alternative internal components of the motorized hand tool such as a motor, motor plate, gearbox, battery, for example, to capture the LED conductors and rigid sleeves in their respective channels.

A ratchet head and motor subassembly 400 according to an aspect of the present invention is described with reference to FIGS. 4A-4D. The ratchet head and motor subassembly 400 shown in FIG. 4A includes a motor assembly 420 coupled to a ratchet head assembly 406. The motor assembly 420 includes an electric motor 420 coupled to a motor end plate such as the motor end plate 424 shown in FIG. 4D.

The motor end plate 426 may be fastened to the electric motor 424 by fasteners such as rivets or screws through fastener holes 430, for example. According to an aspect of the present invention, the motor end plate 426 includes one or more outwardly protruding semi-annular flanges 428. The flanges 428 are configured to fit in a semi-annular slot 432 formed by an undercut behind a lip 434 around a periphery in the ratchet head housing 412. One or more discontinuities in the lip 434 create one or more apertures 436 that are sized to receive each of the one or more flanges 428 of the motor end plate 426 during assembly of the motor end plate 426 to the ratchet head housing 412 and during disassembly of the motor end plate 426 from the ratchet head housing 412. The motor end plate 426, may also include one or more detent structures (not shown) configured to provide tactile indications of proper rotation displacement during assembly.

According to aspects of the present invention, the motor assembly 420 is coupled to the ratchet head housing 412 by pushing the flanges 428 of the motor end plate 426 through the apertures 436 in the lip 434 of the ratchet head housing 412 then rotating the motor assembly 420 relative to the ratchet head housing 412 until the flanges 428 of the motor end plate 426 are secured in the semi-annular slot 432 of the ratchet head housing 412. In one example, the flanges 428 and apertures 436 are sized so that the motor assembly 420 may be rotated 90 degrees in either direction to engage the semi-annular slots 432 of the ratchet head housing 412 during an assembly process or to disengage the semi-annular slots 432 of the ratchet head housing during a disassembly process. A compressible member (not shown) such as a steel wave washer or an O-ring made from a compressible material such as rubber or other elastomer, for example, may be installed between the motor assembly 420 and the ratchet head housing 412 to absorb dimensional tolerances. The O-ring is compressed during assembly of the motor assembly 420 to the ratchet head housing 412 and provides pressure between the flange 428 and lip 434 that facilitates a tight fit and alignment of drive gears, for example.

Figure 5:
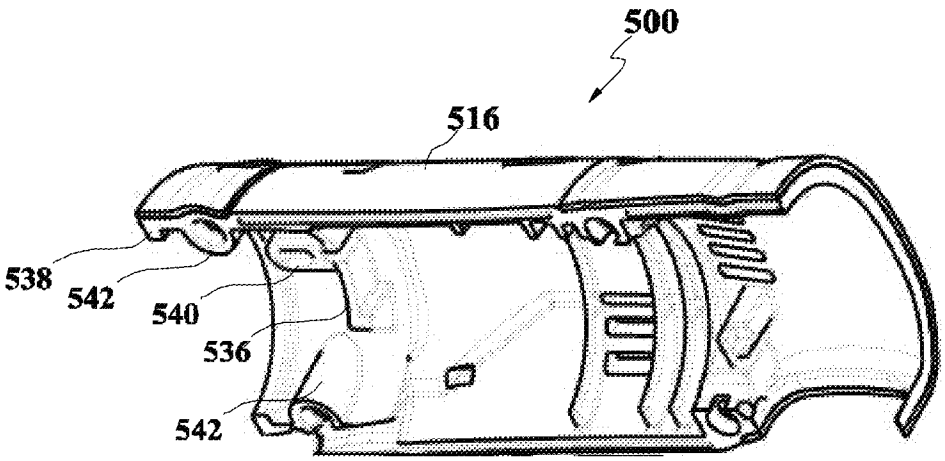
FIG. 5 is an illustration of a clamshell housing portion in accordance with an embodiment of the present invention.

In an embodiment of the present invention, a rib protruding inwardly from one or more clamshell housing portions is shaped to substantially fill the one or more apertures 436 when the clam shell housing is assembled to the ratchet head and motor subassembly 400. Referring to FIG. 5, one or more semi-annular ribs 536 in a first clamshell housing portion 516 are shaped to fit into and substantially fill the one or more apertures 436, for example. The semi-annular ribs 536 prevent the motor end plate 426 from rotating out of the slot 432 in the ratchet head housing 412.

According to another embodiment of the present invention, one or more clamshell housing portions include one or more protrusions extending inwardly from the clamshell housing.

Figure 4A:
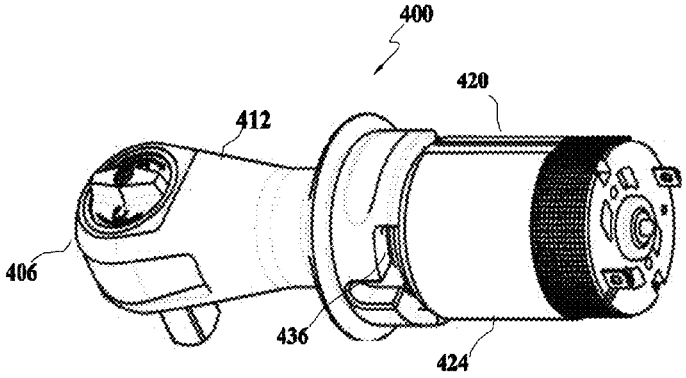
FIG. 4A is a side view illustration of an exemplar tool having a ratchet head and motor subassembly of a cordless ratchet tool in accordance with an embodiment of the present invention.
Figure 4B:
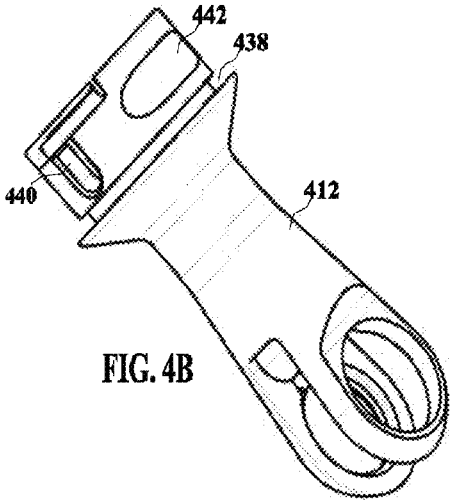
FIG. 4B is a perspective side view illustration of a ratchet head housing of a cordless ratchet tool in accordance with an embodiment of the present invention.
Figure 4C:
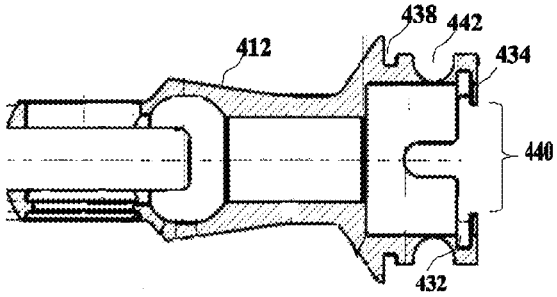
FIG. 4C is a cross sectional view of a ratchet head housing of a cordless ratchet tool in accordance with an embodiment of the present invention.
Figure 4D:
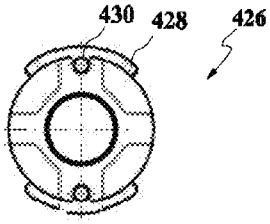
FIG. 4D is an illustration of a motor end plate of a cordless ratchet tool in accordance with an embodiment of the present invention.

The one or more protrusions tightly engage similarly shaped voids in the ratchet head assembly. Referring to FIG. 5, the protrusions may include a radial flange 538, a T-shaped protrusion 540 and/or one or more screw bosses 542. The protrusions tightly engage the ratchet head housing when the clamshell housing portions are fastened together. Referring to FIGS. 4A-4C, the ratchet head housing 412 may include a radial flange slot 438, a T-shaped aperture 440 and/or one or more concave channels 442 arranged to tightly receive the radial flange 538, the T-shaped protrusion 540 and/or the one or more screw bosses 542, respectively.

Referring to FIG. 2, a first clamshell housing portion 216 may be fastened to a second clamshell housing portion 218 around the ratchet head assembly 206 using fasteners such as screws or rivets, for example. When assembled, as shown in FIGS. 1A and 1B, for example, the inward protrusions on the clamshell housing prevent the ratchet head assembly from rotating or moving axially relative to the clamshell housing. The cordless ratchet tool 100 shown in FIGS. 1A and 1B may include the radial flange 538, a T-shaped protrusion 540 and/or one or more screw bosses 542 engaged with the radial flange slot 438, T-shaped aperture 440 and/or one or more concave channels 442 described above are used to reduce parts count and eliminate the manufacturing steps that would otherwise be needed to install clamp nuts or screws dedicated to fastening the ratchet head assembly to the clamshell housing. The disclosed cordless ratchet tool 100 may be constructed without externally projecting clamp nuts or screws that could loosen and/or interfere with comfortable use of the tool.

Figure 6:
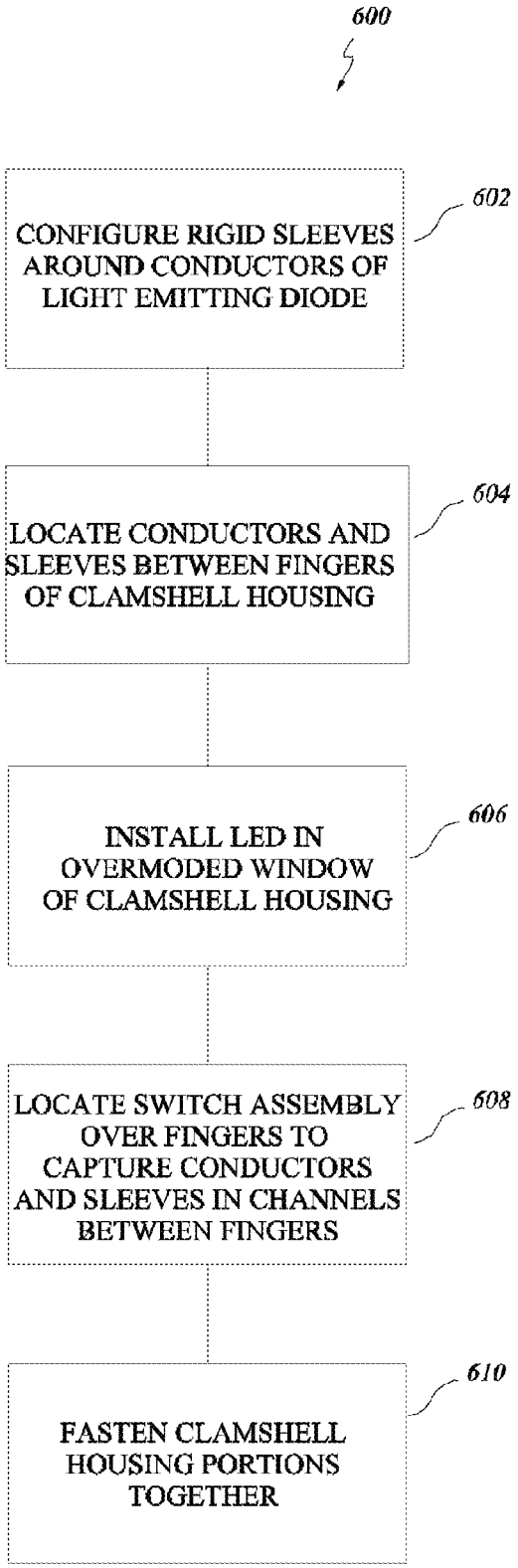
FIG. 6 is a process flow diagram illustrating a method of assembling a cordless ratchet tool in accordance with an embodiment of the present invention.

FIG. 6 is a process flow diagram illustrating a process 600 for assembling a motorized hand tool according to an aspect of the present invention. As shown, the process 600 begins and proceeds to step 602, which includes configuring a set of rigid sleeves around each conductor of a set of conductors extending from a light emitting diode (LED). In step 604, the process includes locating the set of conductor in a corresponding set of channels, in which each of the channels is defined between a pair fingers molded in a first clamshell housing portion. According to an aspect of the application, the rigid sleeves form a friction fit between corresponding pairs of the fingers.

In step 606, the process includes installing the LED in an overmolded window in the first portion of the clamshell housing. In step 608, the process includes capturing the set of conductors in the channel by locating a switch assembly over the set of channels. In step 610 the process includes aligning a second clamshell housing portion against the first clamshell housing portion and installing one or fasteners to couple the first clamshell housing portion to the second clamshell housing portion.

As discussed above, the aspects of the present invention are described in terms of a cordless ratchet tool 100 as shown in FIG. 1. However, it should be understood that aspects of the present invention could be implanted in other hand tools or implements. For example, and without limitation, a ratchet wrench, open wrench, screw driver, nut driver, or any other tool capable of applying torque to a work piece.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A motorized hand tool apparatus, comprising:
- an internal component;
- a clamshell housing assembled around the internal component;
- a window extending through the clamshell housing;
- a window boss extending at least partially around the window within the clamshell housing;
- a set of fingers extending from the window boss and defining a set of channels between the clamshell housing and the internal component,
- a light emitting diode (LED) partially enclosed within the clamshell housing by the window;
- a set of conductors extending from the LED; and
- a set of rigid sleeves each encapsulating a respective one of the conductors, each of the rigid sleeves retained in a respective one of the channels by a friction fit with the fingers.

2. The motorized hand tool apparatus of claim 1, wherein the internal component covers the set of channels and is arranged to contain the set of rigid sleeves in set of channels.

3. The motorized hand tool apparatus of claim 1, wherein the set of rigid sleeves comprise a set of shrink wrap coverings each installed over a respective one of the conductors.

4. The motorized hand tool apparatus of claim 1, wherein each sleeve of the set of rigid sleeves are molded over the corresponding conductor.

5. The motorized hand tool of claim 1, wherein the clamshell housing includes a first clamshell housing portion fastened to a second clamshell housing portion around the internal component.

6. The motorized hand tool of claim 1, wherein the internal component includes control circuitry coupled to the LED.

7. The motorized hand tool of claim 1, further comprising a motor assembly coupled to a switch assembly and a ratchet head assembly coupled to the motor assembly, wherein the clamshell housing includes a first clamshell housing portion fastened to a second clamshell housing portion around the motor assembly the switch assembly and the ratchet head assembly.

8. A method of assembling a motorized hand tool apparatus, comprising:
- configuring a set of rigid sleeves around each conductor of a set of conductors extending from a light emitting diode (LED);
- locating the set of conductor in a corresponding set of channels, each of the channels defined between a pair fingers molded in a first clamshell housing portion, wherein the rigid sleeves form a friction fit against the pair of fingers.

9. The method of claim 8, further comprising capturing the set of conductors in the channel by locating a switch assembly over the set of channels.

10. The method of claim 8, further comprising aligning a second clamshell housing portion against the first clamshell housing portion, and installing one or fasteners to couple the first clamshell housing portion to the second clamshell housing portion.

11. The method of claim 8, further comprising installing the LED in an overmolded window in the first portion of the clamshell housing.

12. The method of claim 8, wherein the set of rigid sleeves comprise a set of shrink wrap coverings each installed over a respective one of the conductors.

13. The method of claim 8, wherein each sleeve of the set of rigid sleeves are molded over the corresponding conductor.

14. A motorized cordless ratchet wrench, comprising:

a motor assembly;

a ratchet head assembly coupled to the motor assembly;

a switch assembly coupled to the motor assembly;

a clamshell housing assembled around the switch assembly;

an overmolded window extending through the clamshell housing;

a window boss extending at least partially around the window within the clamshell housing;

a set of fingers extending from the window boss and defining a set of channels between the clamshell housing and the switch assembly, a light emitting diode (LED) partially enclosed within the clamshell housing by the window;

a set of conductors extending from the LED; and a set of rigid sleeves each encapsulating a respective one of the conductors, each of the rigid sleeves retained in a respective one of the channels by a friction fit with the fingers;

wherein the switch assembly covers the set of channels and is arranged to contain the set of rigid sleeves in set of channels.

* * * * *